US011187119B2

(12) United States Patent
Jensen et al.

(10) Patent No.: US 11,187,119 B2
(45) Date of Patent: Nov. 30, 2021

(54) LATCH PIN FOR USE IN VALVE LIFTER AND VALVE LIFTER

(71) Applicant: Eaton Intelligent Power Limited, Dublin (IE)

(72) Inventors: Jason M. Jensen, Vicksburg, MI (US); Matthew A. Vance, Kalamazoo, MI (US); Douglas R. Cornett, Roxboro, NC (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/022,440

(22) Filed: Sep. 16, 2020

(65) Prior Publication Data

US 2021/0079817 A1 Mar. 18, 2021

Related U.S. Application Data

(60) Provisional application No. 62/901,147, filed on Sep. 16, 2019.

(51) Int. Cl.

| | |
|---|---|
| ***F01L 1/24*** | (2006.01) |
| ***F01L 13/00*** | (2006.01) |
| *F01L 1/46* | (2006.01) |
| *F01L 1/245* | (2006.01) |

(52) U.S. Cl.

CPC ..... *F01L 13/0005* (2013.01); *F01L 1/46* (2013.01); *F01L 2001/2427* (2013.01); *F01L 2001/256* (2013.01)

(58) Field of Classification Search

CPC ..... F01L 2001/2427; F01L 2001/256; F01L 13/0005; F01L 2303/00

USPC ..... 123/90.48, 90.55

See application file for complete search history.

(56) References Cited

U.S. PATENT DOCUMENTS

| | | | | |
|---|---|---|---|---|
| 6,497,207 | B2 | 12/2002 | Spath et al. | |
| 6,578,535 | B2 | 6/2003 | Spath et al. | |
| 7,263,956 | B2 | 9/2007 | Spath et al. | |
| 2002/0046718 | A1 | 4/2002 | Spath et al. | |
| 2002/0195072 | A1* | 12/2002 | Spath ..... | F01L 13/0031 123/90.16 |

(Continued)

FOREIGN PATENT DOCUMENTS

| | | | |
|---|---|---|---|
| DE | 102007016740 | A1 | 10/2008 |
| EP | 0695395 | B1 | 9/1997 |

(Continued)

*Primary Examiner* — Jorge L Leon, Jr.
(74) *Attorney, Agent, or Firm* — Mei & Mark, LLP

(57) ABSTRACT

Shown is a latch pin for use in a valve lifter and a valve lifter including the same. The latch pin for selectively latching within a pin chamber provided in the valve lifter is configured as a whole as a cylindrical pin with one end in the shape of a spherical crown, wherein a stepped flat is formed on radially one side of said one end and is dimensioned to be received within the pin chamber to engage with an axial latching surface thereof. On the top side of said one end, a first relief is formed by beveling the spherical crown, and on the radially other side opposite to the stepped flat across said first relief, a second relief is formed by beveling the spherical crown, wherein the second relief radially adjoins the first relief and circumferentially adjoins a remaining pin face in the shape of the spherical crown.

15 Claims, 4 Drawing Sheets

(56) References Cited

U.S. PATENT DOCUMENTS

| | | | | |
|---|---|---|---|---|
| 2003/0075129 | A1* | 4/2003 | Spath | F01L 13/0031 123/90.16 |
| 2005/0120989 | A1* | 6/2005 | Geyer | F01L 13/0005 123/90.59 |
| 2006/0225684 | A1* | 10/2006 | Spath | F01L 1/146 123/90.59 |
| 2007/0006838 | A1 | 1/2007 | Hendriksma et al. | |
| 2008/0314343 | A1* | 12/2008 | Spath | F01L 1/146 123/90.16 |
| 2009/0199805 | A1* | 8/2009 | Hendriksma | F01L 1/2405 123/90.55 |
| 2009/0308339 | A1* | 12/2009 | Hendriksma | F01L 1/14 123/90.46 |
| 2011/0048352 | A1* | 3/2011 | Hendriksma | F01L 13/0005 123/90.42 |

FOREIGN PATENT DOCUMENTS

| | | | |
|---|---|---|---|
| EP | 0843078 | B1 | 5/1998 |
| EP | 1239124 | B1 | 12/2003 |
| EP | 2142767 | B9 | 9/2010 |
| KR | 101283038 | B1 | 7/2013 |

* cited by examiner

LATCH PIN FOR USE IN VALVE LIFTER AND VALVE LIFTER

PRIORITY

This application claims the benefit of priority of U.S. Provisional Patent Application Ser. No. 62/901,147 filed Sep. 16, 2019, which is incorporated by reference herein in its entirety.

TECHNICAL FIELD

The present invention relates to a hydraulic valve lifter for use in an engine (e.g. an internal combustion engine), and more particularly to a lifter having an improved latching pin to realize valve deactivation in a push rod engine.

BACKGROUND

Valve/cylinder deactivation is the deactivation of the intake and/or exhaust valves of a cylinder or cylinders during at least a portion of the combustion process. Since valve deactivation reduces the number of engine cylinders within which the combustion process is taking place, it is a proven method by which fuel economy can be improved and also the amount of pollutants emitted from the engine can be reduced.

Some known approaches of providing selective valve deactivation in a push rod engine include to equip the lifters for those valves with some means. For example, in the technology disclosed in Reference Document 1 (U.S. Pat. No. 6,578,535), Document 2 (US20020046718A1) and Document 3 (US20070006838A1), a latch pin is engaged within or disengaged from a circumferential groove (latch pin groove) in a latching surface of a lifter body, so as to activate or deactivate control of an engine valve.

Such lifters to be used with hydraulic lash adjustment (HLA), however, face the problems that the latch pin's response time (for deactivation) is long and has variation.

This can be caused by the latch pin "nesting" in the latch pin groove due to similar geometries. The flow of oil (as an example of hydraulic fluid) around the end of the pin (latching pin nose) is hindered by the geometry of the prior art pin, as shown by arrows at both sides of examples in FIG. 1.

Therefore, there is a need to improve oil flow around the end of the latch pin.

Further, a spherical radius on the latch pin nose would dive into the oil supply hole provided in the latch pin groove and would prevent the inner body of the HLA from rotating in the outer body of the HLA or the cylinder deactivation lifter.

SUMMARY OF THE INVENTION

In order to solve the above-mentioned problems, the present invention improves the oil flow around the end of the latch pin by changing the geometric shape of the end of the latch pin.

A first aspect of the invention relates to a latch pin for use in a valve lifter and for selectively latching within a pin chamber provided in the valve lifter. The latch pin as a whole is configured as a cylindrical pin with one end in the shape of a spherical crown, wherein a stepped flat is formed on radially one side of said one end and is dimensioned to be received within the pin chamber to engage with an axial latching surface thereof. On the top side of said one end, a first relief is formed by beveling the spherical crown, and on the radially other side opposite to the stepped flat across said first relief, a second relief is formed by beveling the spherical crown, wherein the second relief radially adjoins the first relief and circumferentially adjoins a remaining pin face in the shape of the spherical crown.

In an exemplary configuration, the first relief and/or the second relief is a flat surface.

A second aspect of the invention relates to a valve lifter, comprising: a cylindrical hollow lifter body; a latch pin as stated above; and a pin housing arranged inside said lifter body and configured to receive the latch pin. Said latch pin is selectively placed in an engagement position or a disengagement position, wherein in the engagement position, the latch pin is engaged within a pin chamber defined in an inner wall surface of said lifter body, thereby preventing relative axial movement between the pin housing and the lifter body, so that axial reciprocating movement of the lifter body causes opening and close of an engine valve via the pin housing; and in the disengagement position, the latch pin is disengaged from the pin chamber, thereby permitting relative axial movement between the pin housing and the lifter body, so that axial reciprocating movement of the lifter body does not cause valve operation via the pin housing.

In an exemplary configuration, said pin chamber is configured as an annular groove extending along the entire circumference of the lifter body.

In an exemplary configuration, the radius of the pin face in the shape of the spherical crown is less than the radius of a radial bottom surface of the pin chamber.

In an exemplary configuration, a latch shelf radius of the stepped flat is less than the radius of a radial bottom surface of the pin chamber.

In an exemplary configuration, said one end of the latch pin is formed with two pin faces spaced from each other across the first relief and second relief, and the two pin surfaces respectively make contact with a radial bottom surface of said pin chamber at two separate points of contact.

In an exemplary configuration, the valve lifter comprises two said latch pins which are biased radially outward away from each other by a spring, wherein each of the two latch pins define a pin bore at the other end opposite to said one end, and each pin bore is configured to receive a corresponding end of said spring.

In an exemplary configuration, said latch pins are biased by the spring radially outwards such that in the engagement position, said one end of each latch pin protrudes out of the pin housing into said pin chamber and the stepped flat engages with the axial latching surface of the pin chamber; and said latch pins are configured to move toward each other when said pin chamber is pressurized by a fluid, such that in the disengagement position, each latch pin retracts from the pin chamber against the spring force of said spring.

According to the present invention, in the engagement position of the latch pin, the rotational movement of the cam of the engine can be transmitted by means of the valve lifter to operate the valve. In particular, the specially designed latch pin according to the invention can be switched to the disengagement position in a short time and thus allow the pin housing to move relative to the lifter body, such that the rotational movement of the engine cam can be interrupted so as to quickly deactivate the valve.

Therefore, the present invention provides a lifter with improved switch response time, in which the latch pin can be prevented from entering the oil supply hole by means of the modified geometry of the latch pin, thereby reducing the response time of the latch pin.

DESCRIPTION OF THE PREFERRED EMBODIMENTS

Figure 1:
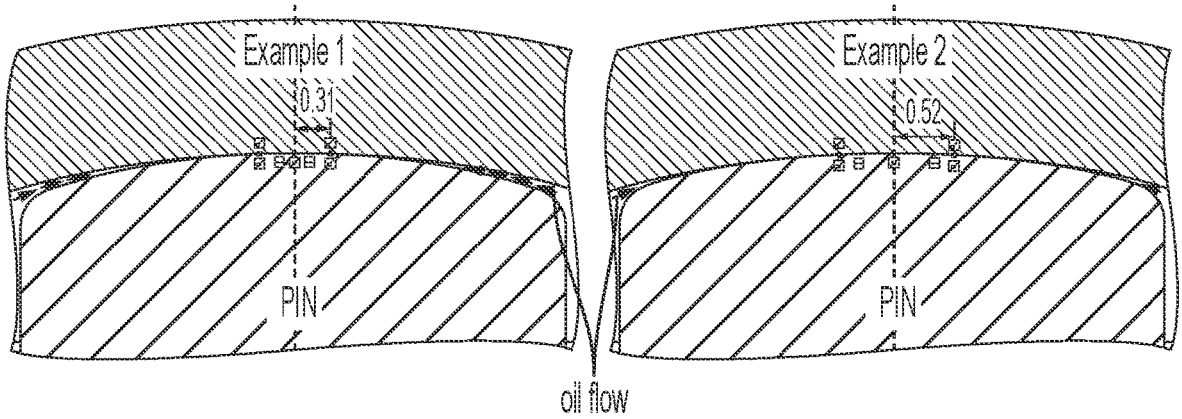
FIG. 1 (PRIOR ART)
FIG. 1 shows a schematic view of oil flow around the end of a latch pin in prior art.
Figure 2:
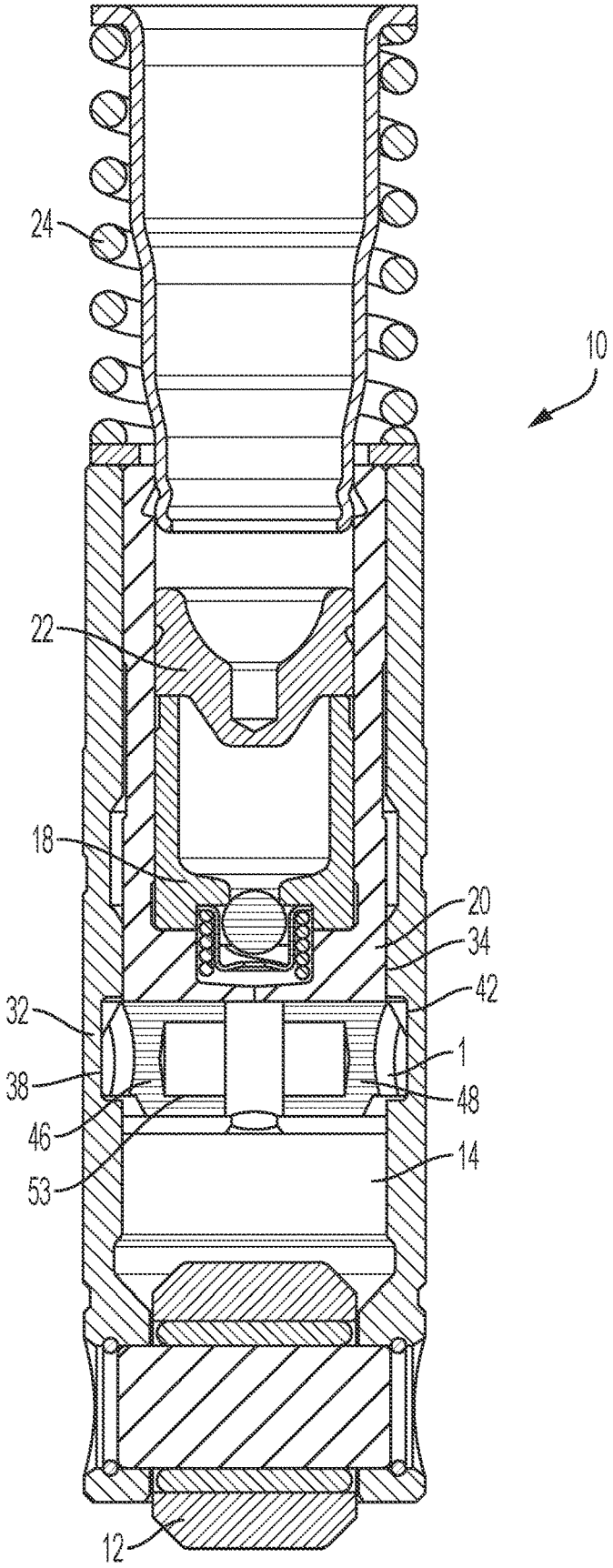
FIG. 2 shows an embodiment of a hydraulic deactivation lifter according to the invention.

FIG. 2 shows an embodiment of a hydraulic deactivation lifter (HDL) 10 of the present invention. The HDL 10 includes a roller 12, a lifter body 14, a deactivation pin assembly (latch pin assembly) 1, a plunger assembly 18, a pin housing 20, a pushrod seat assembly 22, and a spring 24.

The deactivation pin assembly 1 is received within the pin housing 20, which is in turn arranged inside the cylindrical hollow lifter body 14. The deactivation pin assembly 1 is normally placed in an engagement position where it engages with the lifter body 14, thereby transferring the axial reciprocating movement of the lifter body 14 to the pin housing 20 and further to the plunger assembly 18 and pushrod seat assembly 22. In this engagement position, the axial reciprocating movement of HDL 10 opens and closes a valve of the engine.

When the deactivation pin assembly 1 disengages from the lifter body 14, the lifter body 14 is decoupled from pin housing 20 accordingly and, in turn, the plunger assembly 18 and pushrod seat assembly 22 are decoupled from the axial reciprocating movement of lifter body 14.

The lifter body 14 may correspond to at least a part of outer body of HDL 10, while the pin housing 20 may correspond to at least a part of inner body of HDL 10.

The lifter body 14 includes a cylindrical wall 32 defining an oil supply hole 38. An inner surface 34 of the cylindrical wall 32 defines an annular pin chamber 42 therein. Preferably, the annular pin chamber 42 is a continuous groove (latch pin groove) having a predetermined axial height and extending along the entire circumference of the inner surface 34 of the cylindrical wall 32. The oil supply hole 38 is defined by an opening that extends through the cylindrical wall 32, terminating at and opening into the annular pin chamber 42. Thus, the oil supply hole 38 provides a fluid passageway through the cylindrical wall 32 into the annular pin chamber 42. Pressurized oil may be injected through the oil supply hole 38 into the annular pin chamber 42, so that the deactivation pin assembly 1 is pushed by the pressurized oil to retract from the annular pin chamber 42 to be thus disengaged from the lifter body 14.

The deactivation pin assembly 1 includes two pin members 46, 48 (the two are identical, thus only one of them will be described hereinafter), which are biased radially outward relative to the pin housing 20 by a pin spring 51 interposed therebetween.

Figure 3:
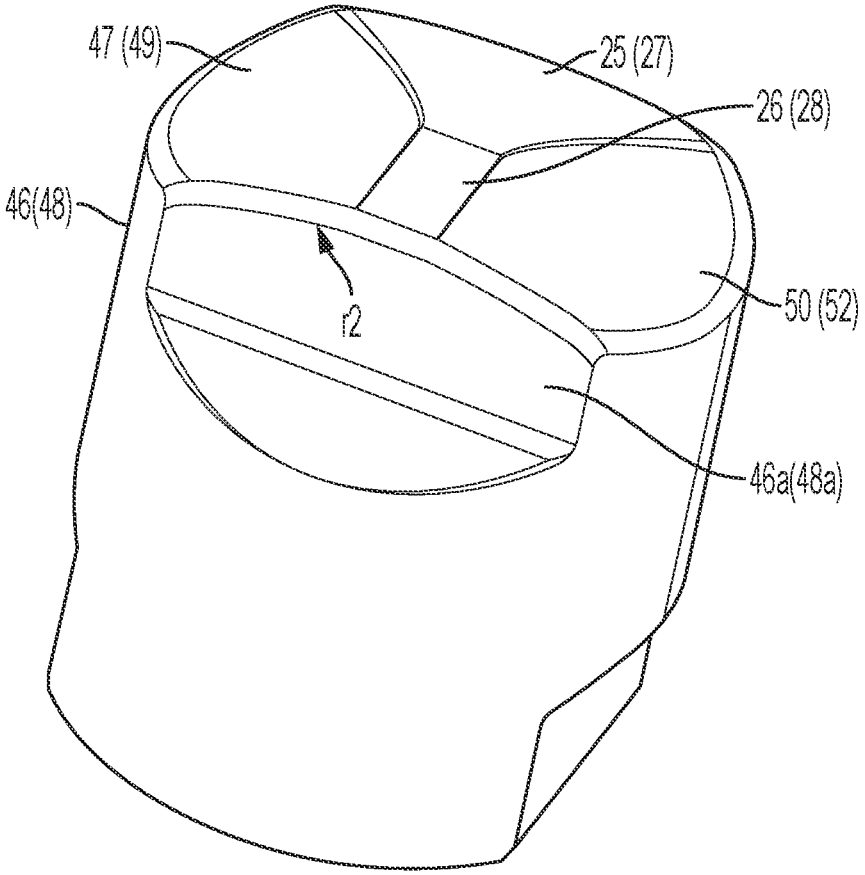
FIG. 3 shows a perspective view of a latch pin according to an embodiment of the invention.

As shown in FIG. 3, each of the pin members 46, 48 is a cylindrical pin on the whole, having a stepped flat 46*a*, 48*a* on radially one side of one of ends. The stepped flat 46*a* (48*a*) is dimensioned to be received within the annular pin chamber 42 (latch pin groove).

Figure 4:
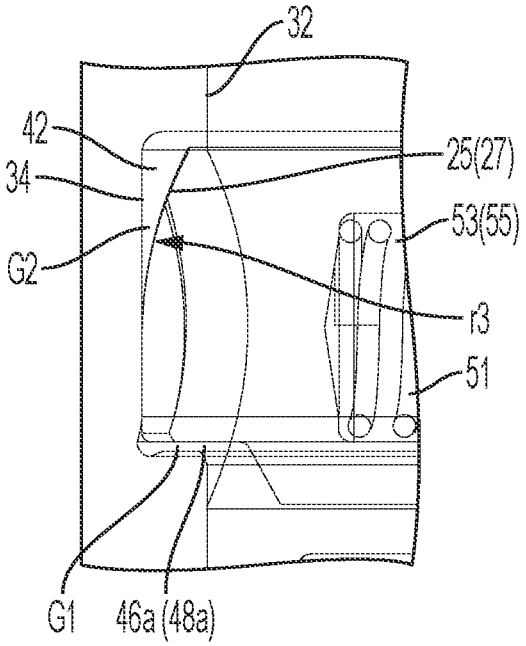
FIG. 4 shows a schematic side view of a latch pin in engagement state and its surroundings according to an embodiment of the invention.

More specifically, referring to FIG. 4, a small gap G1 is provided between the stepped flat 46*a* (48*a*) and a lower side wall of the annular pin chamber 42, thereby allowing for free movement of the pin member 46 (48) into the pin chamber 42. Further, the flat 46*a* (48*a*) can engage with the lower side wall of the pin chamber 42, so that an axial latching surface of the pin chamber is defined by the lower side wall.

Referring back to FIG. 3, each of the pin members 46, 48 includes at one end (i.e., outer end of the latch pin, also called "latch pin nose") pin faces 47(49) and 50(52) as two separate parts of surface of a spherical crown, and as shown in FIG. 4, defines a pin bore 53, 55 at the opposite other end. Each of the pin bores 53, 55 receives a corresponding end of the pin spring 51. In the normal or default engagement position, the pin members 46, 48 of the deactivation pin assembly 1 are biased radially outward by the pin spring 51 such that at least a portion of each pin member 46, 48 is disposed within the annular pin chamber 42 of the lifter body 14.

As shown in FIG. 3, on the top side of said one end of the pin member 46 (48), a relief 26(28) is formed by beveling/chiseling the spherical crown. The relief 26(28) spaces apart the two pin faces 47(49) and 50(52) from each other. With the beveled relief 26(28), it is possible to prevent the pin member from entering the oil supply hole. As used herein, "beveled" or "chiseled" means the surface of the pin end is lowered toward the radially inner side (i.e. substantively towards the center of the spherical crown) as compared to the intact spherical crown (on which the pin faces 47, 49, 50 and 52 lie) into a relief surface. The relief 26(28) is preferably an essentially flat surface.

Further, on the radially other side opposite to the stepped flat 46*a*(48*a*), another relief 25(27) may be formed in a similar way by beveling the spherical crown. The relief 25(27) circumferentially adjoins pin faces 47(49) and 50(52) and radially adjoins the relief 26(28).

As shown in FIG. 4, by means of the beveled relief 25(27), a gap G2 larger than the gap G1 can be effectively formed between the relief 25(27) and a radial bottom surface or inner circumferential surface 34 of the pin chamber 42. The gap G2 can function as an oil flow discharge channel fluidly communicating with the oil supply hole 38, thereby assisting with unblocking the oil supply hole 38.

An ordinary spherical radius of pin member, as taught in the prior art, would dive into the oil supply hole and prevent the inner body of the valve lifter from rotating and also block oil flow. Therefore, as set forth above, by partly beveling the end of the latch pin to form a relief which is e.g. essentially flat, it is possible to prevent the end of the pin member from entering the oil supply hole so as not to block the oil flow, and to allow rotation of the inner body of the lifter relative to the outer body thereof.

Figure 5:
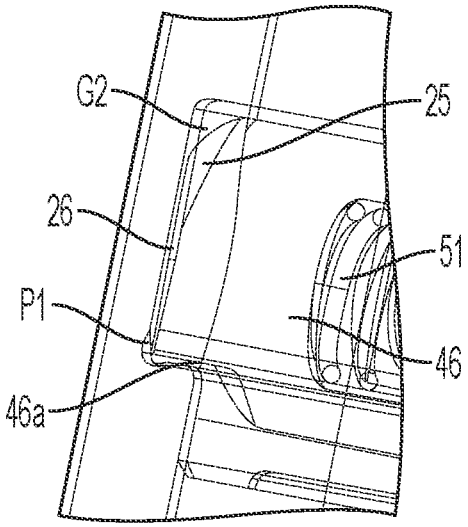
FIG. 5 shows a schematic perspective view of a latch pin in engagement state and its surroundings according to an embodiment of the invention.
Figure 6:
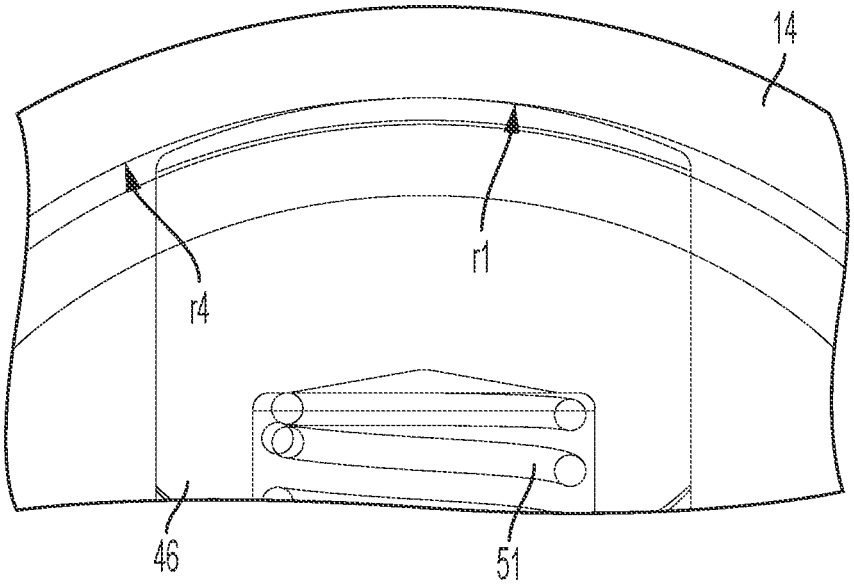
FIG. 6 is a schematic plan view of radius comparison between the latch pin nose and lifter body according to the invention.

As shown in FIG. 6, the radius r1 (also referred to as "latch pin nose radius") of the pin faces 47, 50 (and also pin faces 49, 52) is less than the radius r4 of the radial bottom surface 34 of the annular pin chamber 42 (corresponding to inner radius r4 of the outer body), i.e., r1<r4. This would facilitate the oil to enter between the pin faces 47, 50 (or pin faces 49, 52) and the radial bottom surface of the annular pin chamber 42 around the end of the latching pin. In addition, line contact, rather than point contact, is provided at position P1 (see FIG. 5) between the pin faces 47(49) and the radial bottom surface of the annular pin chamber 42 upon initial engagement of the pin members 46(48) within the annular pin chamber 42. Further, the smaller radius of the pin faces 47(49) would provide a larger effective surface area upon which the pressurized oil injected into the annular pin chamber 42 will act, which facilitates movement of the pin members 46(48) radially toward each other to thereby quickly retract the pin members 46(48) from the annular pin chamber 42.

Preferably, as shown in FIG. 4, a radius r3 (relief radius) of an inscribed circle tangential to both the relief 25 and relief 26 is less than the radius r1 (latch pin nose radius) of the pin surfaces 47, 50, i.e., r3<r1.

Furthermore, as shown in FIG. 3, a latch shelf radius r2 is defined as the radius of the edge at which the pin surfaces 47, 50 interface with the stepped flat 46*a*, and the latch shelf radius r2 is less than the radius r4 of the radial bottom surface of the annular pin chamber 42.

As compared to conventional base design, assembled latch pins according to present invention also meet the following design constraints C1 and C2:

C1: Latch travel to remain same as base design regardless of inner body orientation to outer body.

C2: Latch engagement area (between the stepped flat 46*a*, 48*a* and the lower wall surface of the annular pin chamber 42) to remain same as base design.

In addition, in FIG. 5, a contact point between the pin face 50 and the radial bottom surface of the annular pin chamber 42 at position P1 is shown. Similarly, the pin face 47 and the radial bottom surface of the annular pin chamber 42 also make contact at another position. Therefore, there are a total of two points of contact.

The present invention is herein described and illustrated in connection with a valve-deactivating hydraulic lifter for use with a pushrod type valve train, but the invention can also be applied in, for example, a valve-deactivating hydraulic lash adjuster for closing valve.

While the invention has been described by reference to various specific embodiments, it should be understood that numerous changes may be made within the spirit and scope of the inventive concept described. Accordingly, it is intended that the invention not be limited to the described embodiments, but is defined in scope by the following claims.

We claim:

1. A latch pin for use in a valve lifter and for selectively latching within a pin chamber provided in the valve lifter, the latch pin configured as a cylindrical pin with a first end shaped as a spherical crown, wherein a radial edge of the spherical crown includes a stepped flat configured to engage an axial latching surface of the pin chamber, the latch pin comprising:

a first relief formed in a central region of the spherical crown, wherein the first relief is formed by beveling, and a second relief formed at the radial edge opposite the stepped flat, wherein the second relief is formed by beveling such that the second relief radially adjoins the first relief and circumferentially adjoins a remaining pin face of the spherical crown.

2. The latch pin of claim 1, wherein at least one of the first relief and the second relief is a flat surface.

3. A valve lifter, comprising:

the latch pin according to claim 1;

a cylindrical hollow lifter body;

a pin chamber defined in an inner wall surface of said lifter body; and a pin housing arranged inside said lifter body and configured to receive the latch pin, wherein said latch pin is alternately placed in an engagement position and a disengagement position, such that:

in the engagement position, the latch pin protrudes from the pin housing and engages the pin chamber so as to prevent relative axial movement between the pin housing and the lifter body such that axial reciprocating movement of the lifter body causes an opening and closing operation of an engine valve via the pin housing, and in the disengagement position, the latch pin is disengaged from the pin chamber so as to enable relative axial movement between the pin housing and the lifter body such that the opening and closing operation of the engine valve via the pin housing is disabled.

4. The valve lifter of claim 3, wherein said pin chamber is configured as an annular groove.

5. The valve lifter of claim 4, wherein a nose radius (r1) of the spherical crown is less than a radius of the annular groove.

6. The valve lifter of claim 4, wherein a latch shelf radius (r2) of the stepped flat is less than a radius of the annular groove.

7. The valve lifter of claim 4, wherein the pin chamber comprises a bottom surface of a radius (r4) greater than a latch shelf radius (r2).

8. The valve lifter of claim 4, wherein:

said remaining pin face includes two pin faces spaced from each other across the first relief and second relief, and the two pin faces make contact with said annular groove at two separate points of contact, respectively.

9. The valve lifter of claim 3, wherein said latch pin includes two identical latch pins which are biased radially away from each other by a spring, and wherein each latch pin defines a pin bore at a second end opposite said first end such that each pin bore is configured to receive a corresponding end of said spring.

10. The valve lifter of claim 9, wherein:

the spring biases each latch pin into the engagement position such that each latch pin protrudes out of the pin housing into said pin chamber configured as a latch pin groove, and each latch pin is configured to move into the disengagement position when said pin chamber is pressurized by a fluid such that each latch pin retracts from the pin chamber against a spring force of said spring.

11. A latch pin for use in a valve-deactivating hydraulic lash adjuster and for selectively latching within a pin chamber provided in the valve-deactivating hydraulic lash adjuster, the latch pin comprising:

a cylindrical body with a first end shaped as a spherical crown, a stepped flat formed on a radial edge of the spherical crown, the stepped flat configured to engage an axial latching surface of the pin chamber, a first relief formed in a central region of the spherical crown, wherein the first relief is formed by beveling, and a second relief formed at the radial edge opposite the stepped flat, wherein the second relief is formed by beveling such that the second relief radially adjoins the first relief and circumferentially adjoins a remaining pin face of the spherical crown.

12. The latch pin of claim 11, wherein the first relief is a flat surface.

13. The latch pin of claim 11, wherein the second relief is a flat surface.

14. The latch pin of claim 11, wherein the first relief comprises a first flat surface and the second relief comprises a second flat surface.

15. A deactivation pin assembly for selectively latching within a pin chamber, the deactivation pin assembly comprising:

a first latch pin biased opposite a second latch pin, the first latch pin comprising:

a cylindrical body with a first end shaped as a spherical crown, a stepped flat formed on a radial edge of the spherical crown, the stepped flat configured to engage an axial latching surface of the pin chamber, a first relief formed in a central region of the spherical crown, wherein the first relief is formed by beveling, and a second relief formed at the radial edge opposite the stepped flat, wherein the second relief is formed by beveling such that the second relief radially adjoins the first relief and circumferentially adjoins a remaining pin face of the spherical crown.

* * * * *